US006322233B1

(12) United States Patent
Brandt

(10) Patent No.: US 6,322,233 B1
(45) Date of Patent: Nov. 27, 2001

(54) EMERGENCY FLASHLIGHT

(76) Inventor: Paul K. Brandt, P.O. Box 233, 68 Joseph Street, Port Carling, Ontario (CA), P0B 1J0

( * ) Notice: Subject to any disclaimer, the term of this patent is extended or adjusted under 35 U.S.C. 154(b) by 0 days.

(21) Appl. No.: 09/399,092

(22) Filed: Sep. 20, 1999

Related U.S. Application Data

(60) Provisional application No. 60/111,059, filed on Dec. 7, 1998.

(51) Int. Cl.[7] ..... F21V 33/00

(52) U.S. Cl. ..... 362/199; 362/192; 362/193; 362/399; 362/446; 362/249; 362/96

(58) Field of Search ..... 362/192, 193, 362/199, 399, 446, 249, 96

(56) References Cited

U.S. PATENT DOCUMENTS

| | | | | |
|---|---|---|---|---|
| 3,099,402 | | 7/1963 | Speck | 362/192 |
| 3,345,507 | | 10/1967 | Messinger | 362/192 |
| 3,548,185 | | 12/1970 | Hall | 362/192 |
| 4,041,452 | * | 8/1977 | Moya | 340/134 |
| 4,129,899 | * | 12/1978 | Dunbar | 362/109 |
| 4,315,301 | * | 2/1982 | Jimena | 362/193 |
| 4,332,006 | * | 5/1982 | Choe | 362/193 |
| 4,360,860 | * | 11/1982 | Johnson et al. | 362/192 |
| 4,701,835 | * | 10/1987 | Campagnuolo et al. | 362/192 |
| 4,782,431 | | 11/1988 | Park | 362/161 |
| 5,165,776 | * | 11/1992 | Long-Jen | 362/72 |
| 5,359,500 | * | 10/1994 | Parker | 362/192 |
| 5,552,973 | | 9/1996 | Hsu | 362/192 |
| 5,793,130 | * | 8/1998 | Anderson | 362/192 |
| 5,857,762 | * | 1/1999 | Schwaller | 362/72 |
| 5,982,059 | * | 11/1999 | Anderson | 362/120 |
| 6,036,333 | * | 3/2000 | Spiler | 362/72 |
| 6,086,244 | * | 7/2000 | Ridge | 362/192 |

* cited by examiner

*Primary Examiner*—Sandra O'Shea
*Assistant Examiner*—Anabel M Ton
(74) *Attorney, Agent, or Firm*—Sim & McBurney

(57) ABSTRACT

An emergency flashlight includes a handle portion and a rotary portion mounted on the handle portion for rotation about a rotary axis. An elongate swing shaft has one end mounted to the rotary portion to rotate therewith, the other end extending substantially radially away from the rotary portion. A light-producing means is mounted on the swing shaft adjacent the end remote from the rotary portion. Inside the handle portion are located generating means and gear means, allowing electrical energy to be created by swinging the handle in a circular motion, thereby causing the swing shaft and the rotary portion to rotate with respect to the handle portion. Conductive means such as wires are provided to carry the electrical energy to the bulb.

2 Claims, 2 Drawing Sheets

EMERGENCY FLASHLIGHT

This application claims benefit to U.S. provisional application Ser. No. 60/111,059 filed Dec. 7, 1998.

This invention relates generally to flashlights, and has to do particularly with a flashlight in which electrical energy is produced by a generator which is rotated, via the intermediary of a gear box, by a radial shaft which is swung centrifugally around the gear box.

BACKGROUND OF THIS INVENTION

Most conventional flashlights are powered by storage batteries which typically produce 1.5 volts. A given flashlight may have 1, 2 or more such batteries. A plurality of such batteries is typically hooked up in series so as to produce a total of 3 volts, 4.5 volts, 6 volts, etc.

In order to avoid the necessity of purchasing batteries from time to time, it is possible to construct a flashlight in which the electrical energy is produced by mechanical action, somewhat similar to a bicycle-mounted generator which energizes a light mounted on the handlebars. In one prior development, an elongate housing includes a generator and a hand-operated squeeze trigger, along with the standard light bulb and reflector. The operator continuously squeezes the squeeze trigger, which, through a form of one-way rack-and-pinion gearing, rotates the generator, thus producing electrical energy. The quantity of energy thus produced, however, is limited. Accordingly, it is an object of one aspect of this invention to provide an improved, mechanically-operated flashlight which utilizes centrifugal force to rotate a crank, the energy of which is turned into electrical power by an internal generator.

GENERAL DESCRIPTION OF THIS INVENTION

Accordingly, this invention provides an emergency flashlight comprising:

- a handle portion shaped and sized so as to be easily grasped manually;
- a rotary portion mounted on the handle portion for rotation about a rotary axis with respect to the handle portion;
- an elongate portion having two ends, one end being mounted on the rotary portion for rotation therewith, the other end extending substantially radially away from said rotary axis;
- a light-producing member mounted on the elongate portion adjacent said other end;
- the handle portion including generating means and gear means by which electrical energy can be manually created by swinging the handle portion with a circular motion, thereby causing the elongate portion and rotary portion to rotate about the rotary axis; and
- conductive means for conducting said electrical energy to said light-producing member.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
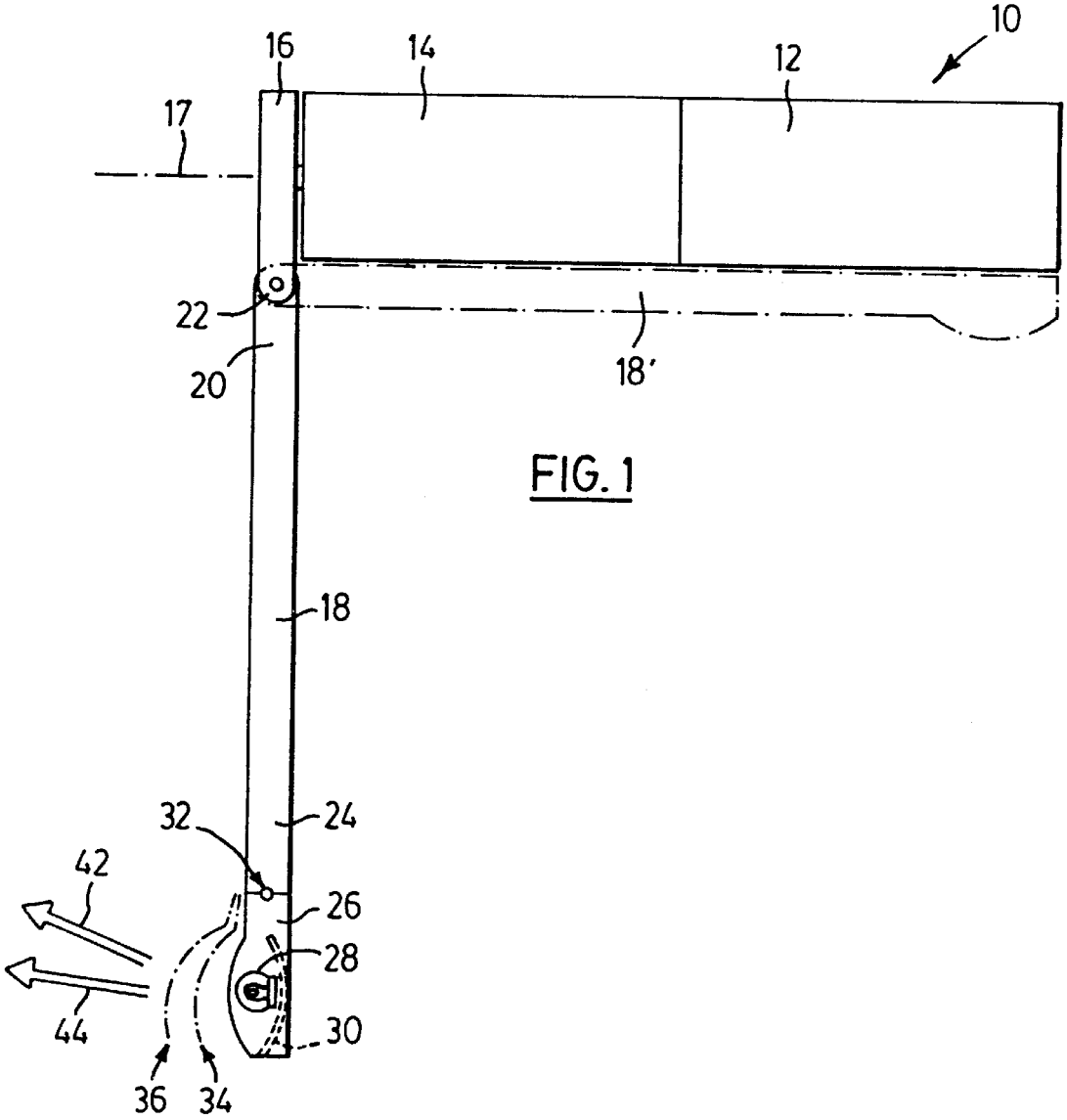
FIG. 1 is an elevational view of the flashlight of this invention.

Attention is first directed to FIG. 1, which shows a flashlight 10 which consists basically of a generator 12, a gear box 14, a cap 16 mounted for rotation about a longitudinal axis 17 shown as a broken line, a shaft 18 having an inner end 20 which is pivotally mounted to a projection 22 on the cap 16, and an outer end 24 on which is mounted a bulb-supporting end piece 26. The bulb is shown at 28 and a conventional reflector (typically part-spherical) at 30.

As can be seen, the shaft 18 can be folded to lie alongside the main body of the flashlight, as indicated in broken lines at 18'.

The end piece 26 is pivoted at 32 and includes detent means (not illustrated) by which the end piece 26 can be adjusted to a first angulation represented by the broken line 34 or a second angulation represented by the broken line 36.

Figure 2:
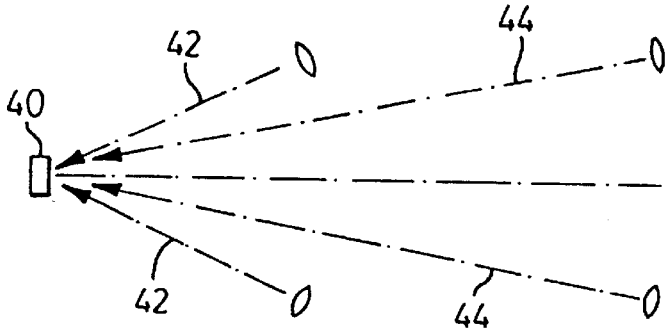
FIG. 2 is a schematic drawing showing the capability of adjustment for distance.

The purpose of providing the two angulated positions is clarified in FIG. 2, in which an object to be illuminated by the flashlight 10 is shown at 40. When the user is standing relatively near the object 40, the end piece 26 can be adjusted to the angulated position 36, from which the beam of light follows a particular convergence angle shown by the arrows 42. When the user stands further away, the end piece 26 can be adjusted to the position represented by the numeral 34, from which the beam of light will proceed along the convergence angle shown by the arrows 44.

As can be seen in FIG. 2, the angulation represented by the arrows 42 corresponds to a close spacing between the user and the object to be illuminated, whereas the angulation represented by the arrows 44 represents a more distant position with respect to the object 40.

Figure 3:
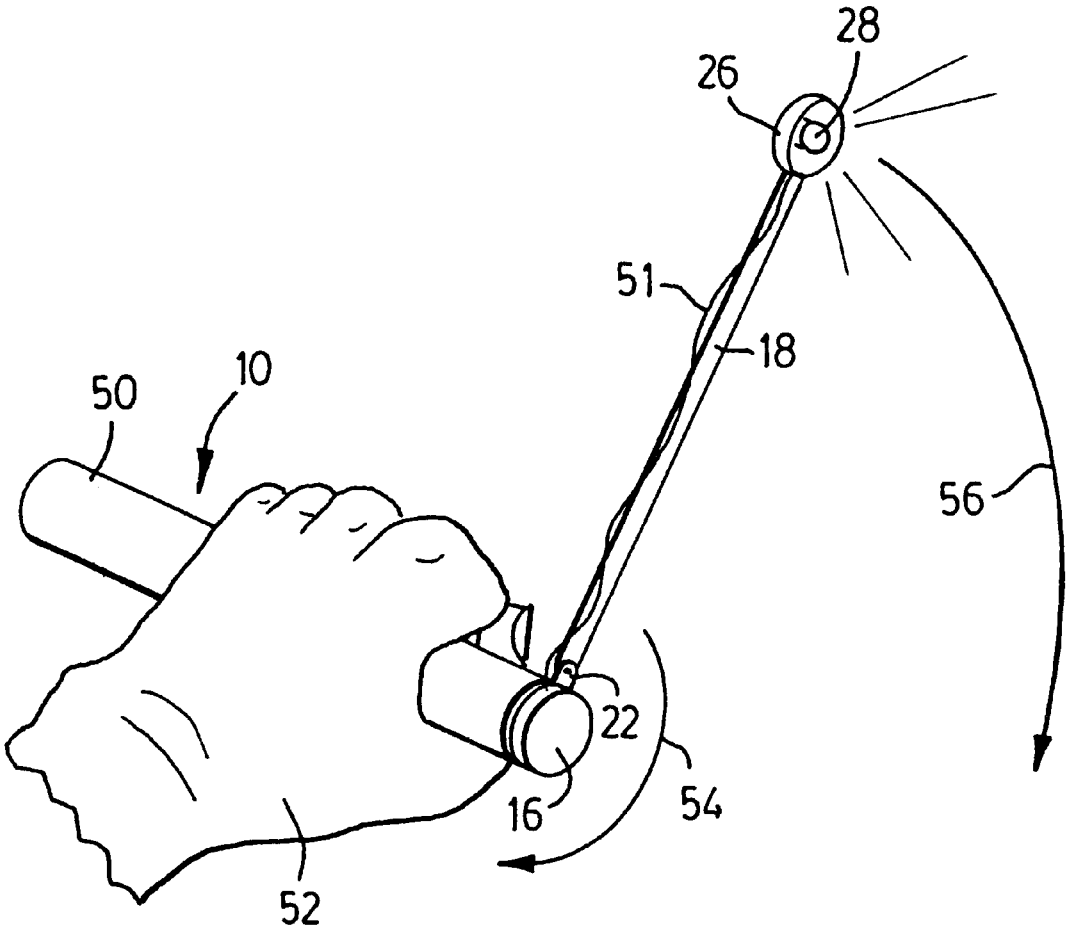
FIG. 3 is a perspective view of the flashlight in operation.

In FIG. 3 there is shown the main cylindrical body 50 of the centrifugal flashlight, having at one end the rotatable cap 16 from which the shaft 18 radially projects (when in use). At the far or distal end of the shaft 18 is supported the end portion 26 described in detail above.

Wires 51 schematically represent conductive means for conducting electrical energy to the bulb 28.

In operation, the flashlight body 50 is grasped in one hand 52, and is rotated as indicated by the arrow 54. This motion swings the shaft 18 in accordance with the arrow 56, rotating the cap 16, turning the generator 12, and powering the bulb 28.

It will be understood by those skilled in the art that the end piece 26 would have to be appropriately weighted, in order to generate sufficient power to illuminate the bulb 28.

It will thus be seen that the flashlight construction set forth herein offers the advantage of the immediate production of light. No time is wasted with cranking or pulling a string. Also, the flashlight set forth herein is a one-hand unit not requiring two hands to operate.

In addition, the construction is relatively simple, requiring only two main portions: the gear box and the generator. A further feature is the ability to generate the electrical energy in a continuous fashion, without interruption. This results in a light beam which is at a constant level, without pulsation.

While one embodiment of this invention has been illustrated in the accompanying drawings and described hereinabove, it will be evident to those skilled in the art that changes and modifications may be made therein, without departing from the essence of this invention, as set forth in the appended claims.

What is claimed is:

1. An emergency flashlight comprising:

a handle portion shaped and sized so as to be easily grasped manually;

a rotary portion mounted on the handle portion for rotation about a rotary axis with respect to the handle portion;

an elongate portion having a first end and a second end, the first end being mounted on the rotary portion so that the elongate portion can rotate along with the rotary portion about said rotary axis when the second end extends substantially radially away from said rotary axis, the elongate portion being adapted, when not rotating about the rotary axis, to swivel in a hypothetical plane containing the rotary axis between a storage position in which it lies substantially alongside the handle portion and an active position in which it extends substantially radially away from said rotary axis;

a light-producing member mounted on the elongate portion;

the handle portion including generating means and gear means by which electrical energy can be manually created by swinging the handle portion with a circular motion, thereby causing the elongate portion and the rotary portion to rotate together about the rotary axis; and conductive means for conducting said electrical energy to said light-producing member.

2. The flashlight claimed in claim 1 in which the light-producing member has a plurality of angular positions, with respect to the elongate portion, in which it can be set, each position corresponding to a particular convergence angle and thus to a particular distance from an object being illuminated.

* * * * *